US006823825B1

(12) United States Patent
Hwang et al.

(10) Patent No.: US 6,823,825 B1
(45) Date of Patent: Nov. 30, 2004

(54) OIL SUPPLY STRUCTURE FOR AN ENGINE CYLINDER HEAD

(75) Inventors: Gyu-Han Hwang, Gyeonggi-do (KR); Bong-Sang Lee, Gyeonggi-do (KR); Seung-Woo Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/611,441

(22) Filed: Jun. 30, 2003

(30) Foreign Application Priority Data

| | | |
|---|---|---|
| Jun. 29, 2002 | (KR) | 10-2002-0037497 |
| Oct. 4, 2002 | (KR) | 10-2002-0060648 |
| Oct. 4, 2002 | (KR) | 10-2002-0060651 |
| Oct. 4, 2002 | (KR) | 10-2002-0060650 |

(51) Int. Cl.[7] ..... F01L 1/34

(52) U.S. Cl. ..... 123/90.15; 123/90.12; 123/90.13; 123/90.38; 123/193.3; 123/193.5

(58) Field of Search ..... 123/90.12, 90.13, 123/90.15, 90.33, 90.34, 90.38, 193.1, 193.3, 193.5, 196 M, 198 DA; 184/6.5, 6.6

(56) References Cited

U.S. PATENT DOCUMENTS

| | | | | |
|---|---|---|---|---|
| 6,032,629 A | * | 3/2000 | Uchida | 123/90.34 |
| 6,035,817 A | * | 3/2000 | Uchida | 123/90.17 |
| 6,227,155 B1 | * | 5/2001 | Tosaka et al. | 123/90.34 |
| 6,343,580 B2 | * | 2/2002 | Uchida | 123/90.17 |

* cited by examiner

*Primary Examiner*—Thomas Denion
*Assistant Examiner*—Kyle M. Riddle
(74) *Attorney, Agent, or Firm*—Morgan Lewis & Bockius LLP

(57) ABSTRACT

An oil supply structure for an engine cylinder head is disclosed. In an engine having a variable valve timing apparatus utilizing oil pressure as an operational power source to smoothly supply lubricating oil for the cylinder head and an operational oil for the variable valve timing apparatus in a clean state, the arrangement of passages allows for ease of installation and maintenance of the components of the oil temperature sensor and oil control valve comprising the variable valve timing apparatus.

15 Claims, 5 Drawing Sheets

OIL SUPPLY STRUCTURE FOR AN ENGINE CYLINDER HEAD

FIELD OF THE INVENTION

The present invention relates to an oil supply structure for an engine cylinder head, and more particularly, to a technique for supplying oil for activation of a variable valve timing apparatus and lubrication of a cylinder head.

BACKGROUND OF THE INVENTION

In general, a cylinder head of an engine is formed with a cam shaft that continuously rotates for opening or closing valves while the engine is in operation, such that lubricating oil must be continuously supplied at all times. Further, some variable valve timing apparatus used for advancing or retarding the opening/closing time period of valves utilize oil pressure as an operational power source. Accordingly, an engine having a variable valve timing apparatus, which uses oil pressure as an operational power source, should be supplied with both a lubricating oil for a cylinder head and an oil for the variable valve timing apparatus.

SUMMARY OF THE INVENTION

The present invention provides an oil supply structure for an engine cylinder head configured to smoothly supply lubricating oil for the cylinder head and operational oil for the variable valve timing apparatus which uses oil pressure as the operational power source. The present invention also is configured to allow components of a variable valve timing apparatus to be easily mounted and maintained.

In a preferred embodiment of the present invention, the oil supply structure comprises an oil chamber so formed as to receive the oil from a main oil gallery of a cylinder block at a lower portion of a cylinder head abutted on an upper portion of the cylinder block. A cam shaft journal oil passage branches from the oil chamber for lubricating a cam shaft journal part. And an oil supply passage branches from the oil chamber for operating a variable valve timing apparatus.

BRIEF DESCRIPTION OF THE DRAWINGS

For fuller understanding of the nature and objects of the present invention, reference should be made to the following detailed description taken in conjunction with the accompanying drawings in which.

DETAILED DESCRIPTION OF THE INVENTION

Hereinafter, the preferred embodiment of the present invention will be described in detail with reference to the accompanying drawings.

Figure 1:
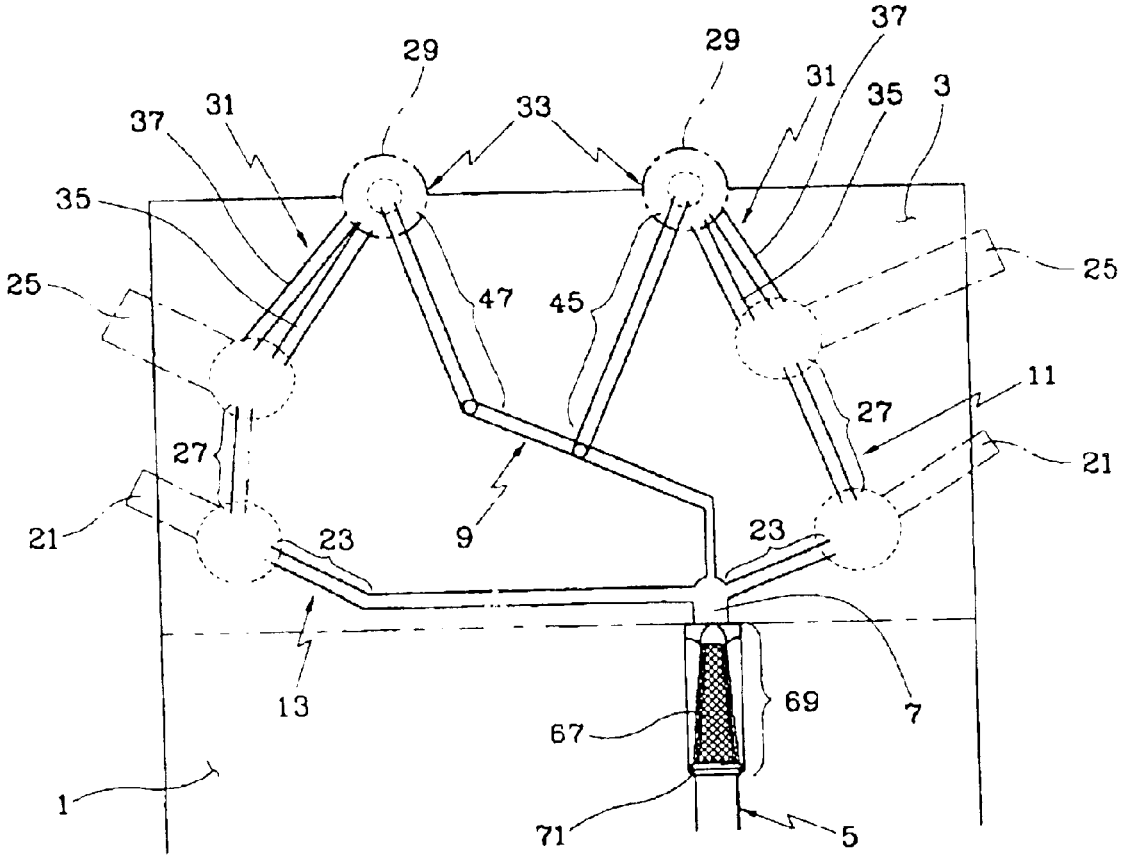
FIG. 1 is a schematic drawing observed from a front of a cylinder head showing an oil supply structure for an engine cylinder head according to an embodiment of the present invention.

As illustrated in FIG. 1, an oil supply structure for a cylinder head according to the embodiment of the present invention includes an oil chamber 7 formed at a lower part of a cylinder head 3 that abuts to an upper part of a cylinder block 1 for receiving the oil from a main oil gallery 5 of the cylinder block 1. A cam shaft journal oil passage 9 branches from the oil chamber 7 for lubrication of a cam shaft. An intake-side oil supply passage 11 branches from the oil chamber 7 for activation of an intake-side variable valve timing apparatus. And an exhaust-side oil supply passage 13 branches from the oil chamber 7 for activation of an exhaust-side variable valve timing apparatus.

Although the embodiment of the present invention is disclosed to provide an engine varying both intake and exhaust valve timings, the following technique may be applied to an engine varying only one of the valve timings. Further, the variable valve timing apparatus may include a continuous variable valve timing apparatus for continuously varying the valve timing. The actuator for the continuous valve timing apparatus may be supplied with the oil through either the intake-side oil supply passage or the exhaust-side oil supply passage.

Figure 2:
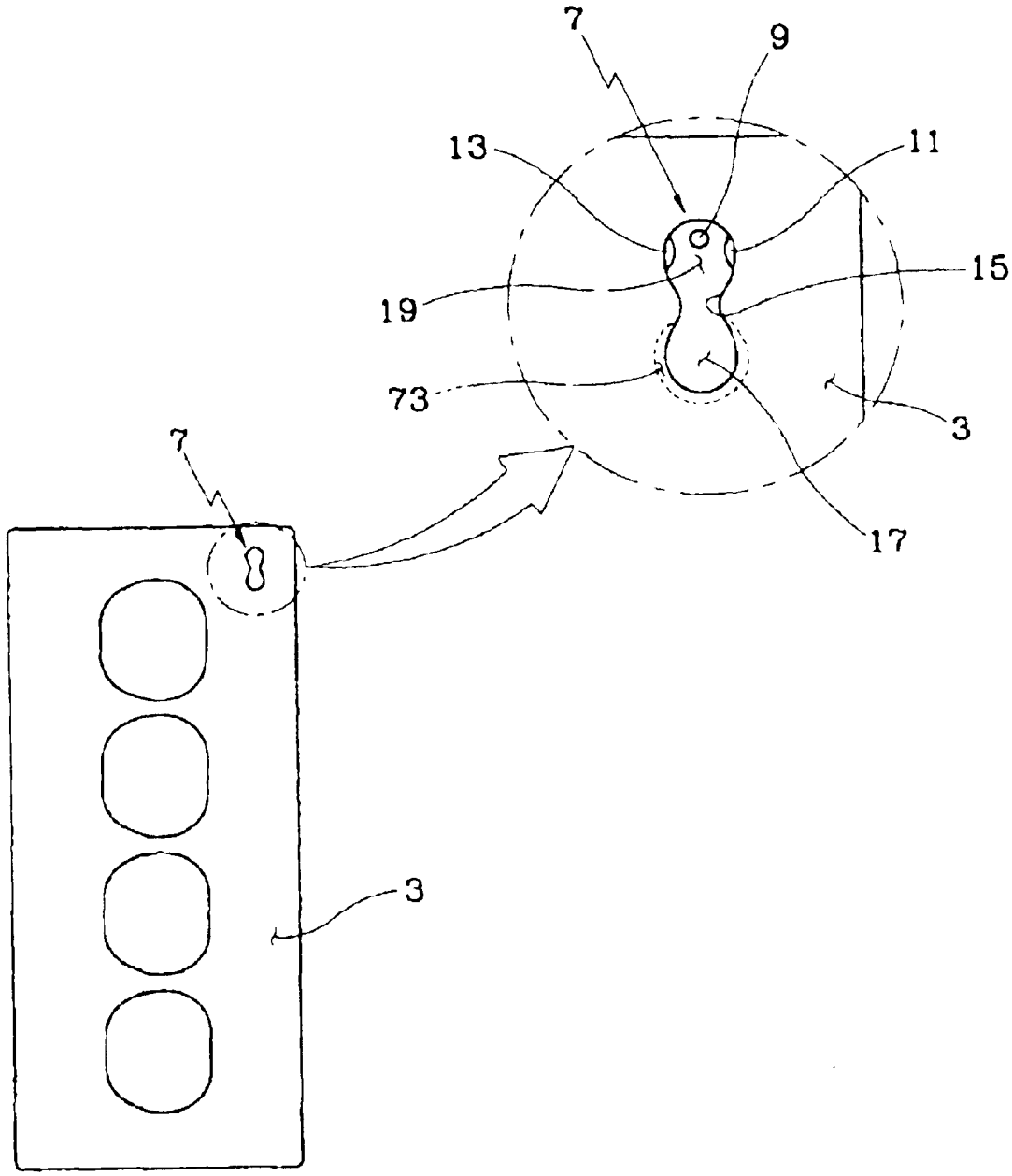
FIG. 2 illustrates a form of an oil chamber observed from a bottom of the cylinder head of FIG. 1.

The oil chamber 7, as observed from a bottom of the cylinder head 3 in FIG. 2, preferably takes a shape of a wasp-waisted groove along a longitudinal direction of the cylinder head 3. Preferably the groove is centrally formed with a contraction part 15 narrowed in width thereof to take the form of a peanut.

In a preferred embodiment, the main oil gallery 5 of the cylinder block 1 is connected to a chamber influx part 17 which is at an inner side of the cylinder head 3 relative to the contraction part 15 of the groove. The cam shaftjournal oil passage 9, the intake-side oil supply passage 11, and the exhaust-side oil supply passage 13 are connected to a chamber efflux part 19 which is at an external side of the cylinder head 3 relative to the contraction part 15 of the groove.

In other words, oil supplied from the main oil gallery 5 is preferably supplied into the chamber influx part 17, and passes through the contraction part 15 to be distributed into the cam shaft journal oil passage 9, the intake-side oil supply passage 11, and the exhaust-side oil supply passage 13 via the chamber efflux part 19. As a result, oil supplied from the main oil gallery 5 is sufficiently provided at the oil chamber 7 for stable and smooth flow into the cam shaft journal oil passage 9, the intake-side oil supply passage 11, and the exhaust-side oil supply passage 13.

The intake-side oil supply passage 11 and the exhaust-side oil supply passage 13, which supply the oil for actuation of the variable valve timing apparatus, respectively include: a temperature sensor section 23 so formed as to pass oil through to an oil temperature sensor 21; a control valve section 27 connected to the temperature sensor section 23 for supplying the oil to an oil control valve 25; and an actuator section 31 for supplying the oil from the oil control valve 25 to a variable valve timing actuator 29.

The temperature sensor section 23 is preferably slanted upwards from the oil chamber 7 towards a lateral surface of the cylinder head 3. Accordingly, as shown in FIG. 1, the temperature sensor section 23 of the intake-side oil supply passage 11 is obliquely formed from the oil chamber 7 toward a right upper side of the cylinder head 3. Also, the temperature sensor section 23 of the exhaust-side oil supply passage 13 is preferably sloped from the oil chamber 7 toward a left upper side of the cylinder head 3.

As each temperature sensor section 23 is formed toward the right and the left upper sides of the cylinder head 3, the oil temperature sensor 21 for measuring the oil temperature provided to the variable valve timing actuator 29 can be mounted from an upper lateral surface of the cylinder head 3 toward an inner lower side of the cylinder head 3. This structure allows the oil temperature sensor 21 to be easily installed and maintained.

The control valve section 27 preferably faces toward the inner side of the cylinder head 3 and is tilted from the temperature sensor section 23 toward a cam shaft journal 33 mounted at an upper side of the cylinder head 3. An actuator section 31 includes an advance oil supply part 35 and a retard oil supply part 37, each being tilted from the control valve section 27 toward the upper side of the cam shaft journal 33.

In other words, as shown in FIG. 1, the control valve section 27, the advance oil supply part 35, and the retard oil supply part 37 are approximately aligned on one linear line from the section of the oil temperature sensor 21 toward the cam shaft journal 33. Therefore, the oil control valve 25 is inserted in the traversing direction of the linear line from the lateral surface of the cylinder head 3.

There is an advantage in the afore-said structure in that the oil control valve 25 can be easily mounted and maintained at the cylinder head 3, wherein the oil control valve 25 receives an electric signal from an Electronic Control Unit (ECU) for engine control to selectively supply the oil from the control valve section 27 to the advanceoil supply part 35 or the retard oil supply part 37.

By way of reference, the oil supplied through the advance or retard oil supply parts 35, 37 is supplied into the variable valve timing actuator 29 which is coupled to a cam shaft 39 through the inner part of the cam shaft 39.

Figure 4:
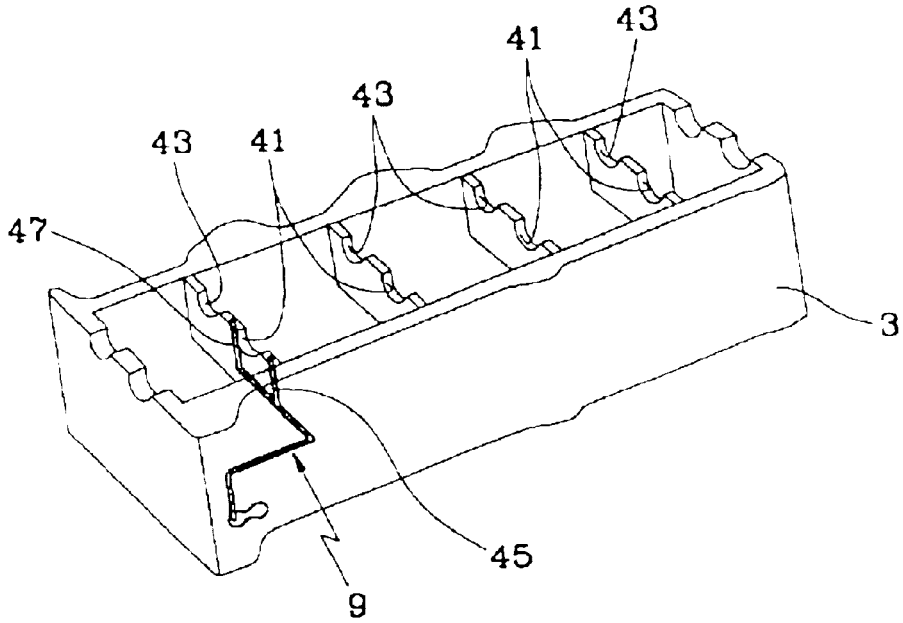
FIG. 4 is a perspective view of a cylinder head structure including an intake-side journal part inlet section and an exhaust-side journal part inlet section of a cam shaft journal oil passage.
Figure 5:
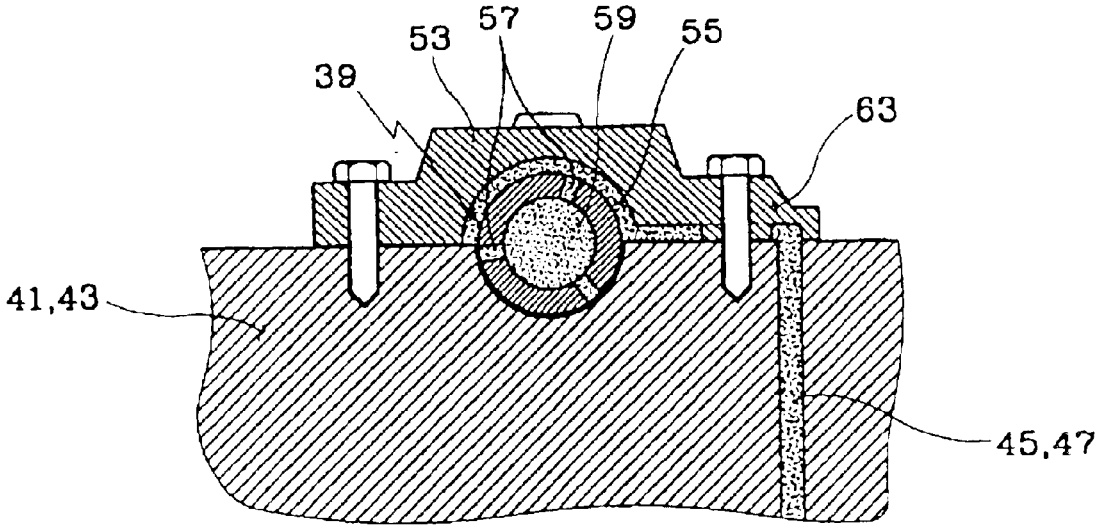
FIG. 5 is a cross-section of a cylinder head portion and bearing cap, with a groove, an influx through hole, and a hollow part according to a preferred embodiment of the invention.

As also shown in FIGS. 4 and 5, the cam shaft journal oil passage 9 includes an intake-side journal part inlet section 45 and an exhaust-side journal part inlet section 47, each communicatively branched out to one intake-side journal part 41 for supporting the intake-side cam shaft and to one exhaust-side journal part 43 for supporting the exhaust-side cam shaft. An intake cam shaft section is connected to the intake-side journal part inlet section 45 for supplying the oil to another intake-side journal part 41 which abuts on the intake-side cam shaft, through the inner side of the intake-side cam shaft. And an exhaust cam shaft section is connected to the exhaust-side journal part inlet section 47 for supplying the oil to another exhaust side journal part 43 which abuts on the exhaust-side cam shaft, through the inner side of the exhaust-side cam shaft.

Figure 6:
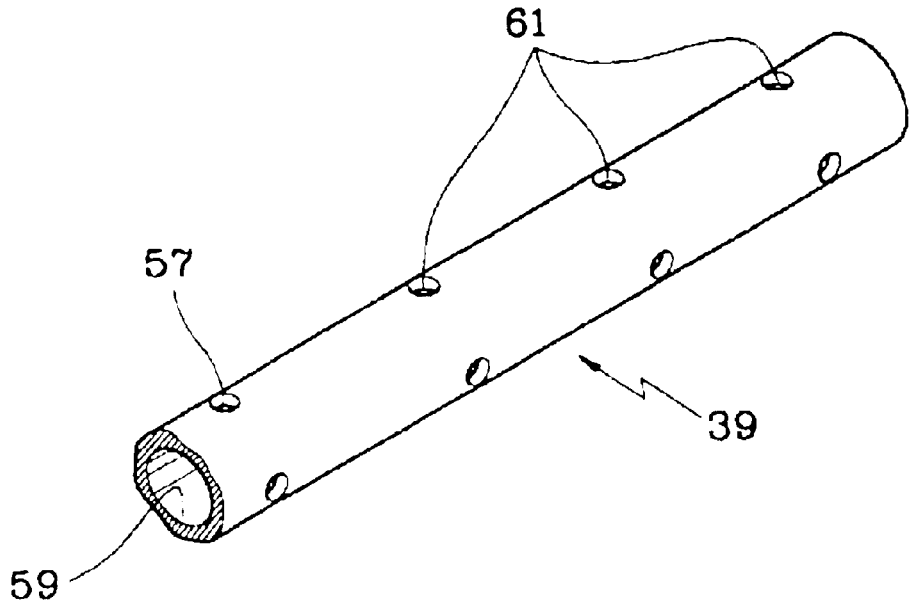
FIG. 6 is a perspective view partially illustrating the cam shaft of FIG. 5, showing an influx through hole and efflux through holes.

FIG. 4 illustrates a structure for the intake-side journal part inlet section 45 and the exhaust-side journal part inlet section 47 of the cam shaft journal oil passage 9. The intake-side journal part inlet section 45 and the exhaust-side journal part inlet section 47 are communicatively formed to the second journal part of the cylinder head. (a secondjournal part from the left side of the drawing) On the other hand, FIGS. 5 and 6 illustrate the structure for both intake cam shaft section and exhaust cam shaft section.

The intake cam shaft section and the exhaust cam shaft section respectively include bearing cap grooves 55, longitudinally formed in the direction encompassing the intake cam shaft or exhaust cam shaft at a bearing cap 53 so as to communicate with the intake-side journal part inlet section 45 or the exhaust-side journal part inlet section 47. Influx through holes 57 are radially formed at the intake and exhaust cam shafts so as to communicate with the bearing cap groove 55. Hollow parts 59 are each centrally and longitudinally formed at the intake and exhaust cam shafts so as to communicate with the influx through hole 57. And efflux through holes 61 are radially formed at the intake and exhaust cam shafts meeting another intake and exhaust-side journal parts 41 and 43 for supporting the intake and exhaust cam shafts so as to communicate with the hollow part 59.

Figure 7:
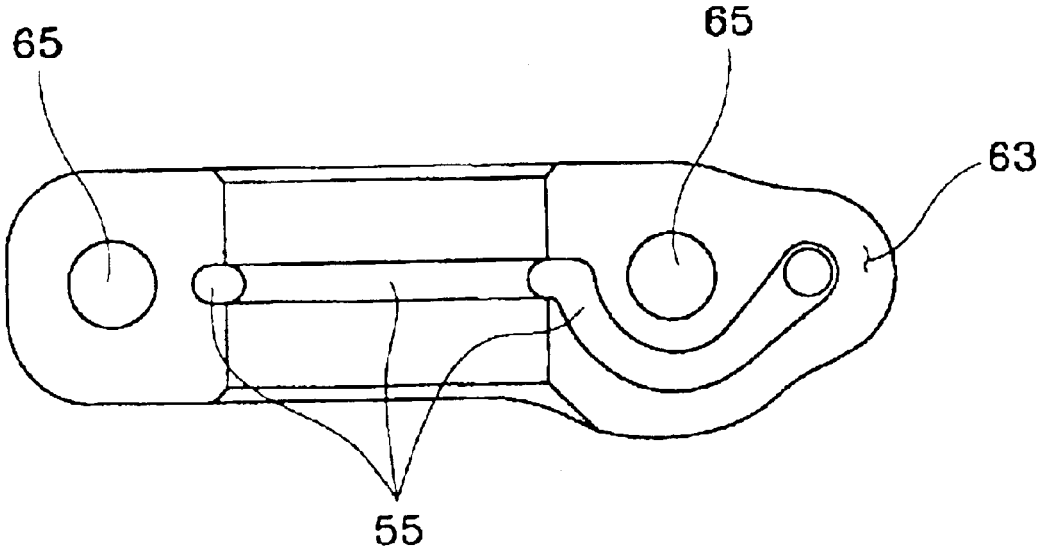
FIG. 7 is a bottom view of a bearing cap of FIG. 5.

As shown in FIGS. 5 and 7, the bearing cap groove 55 is connected with the intake-side journal part inlet section 45 or the exhaust-side journal part inlet section 47 at the bottom side of a cap protrusive part 63 formed at one side of the bearing cap 53. The bearing cap groove 55 is formed to enclose the intake cam shaft or exhaust cam shaft by detouring around a periphery of a cap bolt hole 65 of the bearing cap 53.

Accordingly, the oil supplied for a lubrication of the cam shaft 39 is furnished into the intake-side journal part inlet section 45 and the exhaust-side journal part inlet section 47 from the oil chamber 7 to be supplied into the influx through hole 57 via the bearing cap groove 55 mounted at the bearing cap 53. The oil moves through the hollow part 59 to be discharged to the efflux through hole 61, such that lubrication is made at the portion that abuts on another intake/exhaust-side journal parts 41, 43 which support the cam shaft 39.

Figure 3:
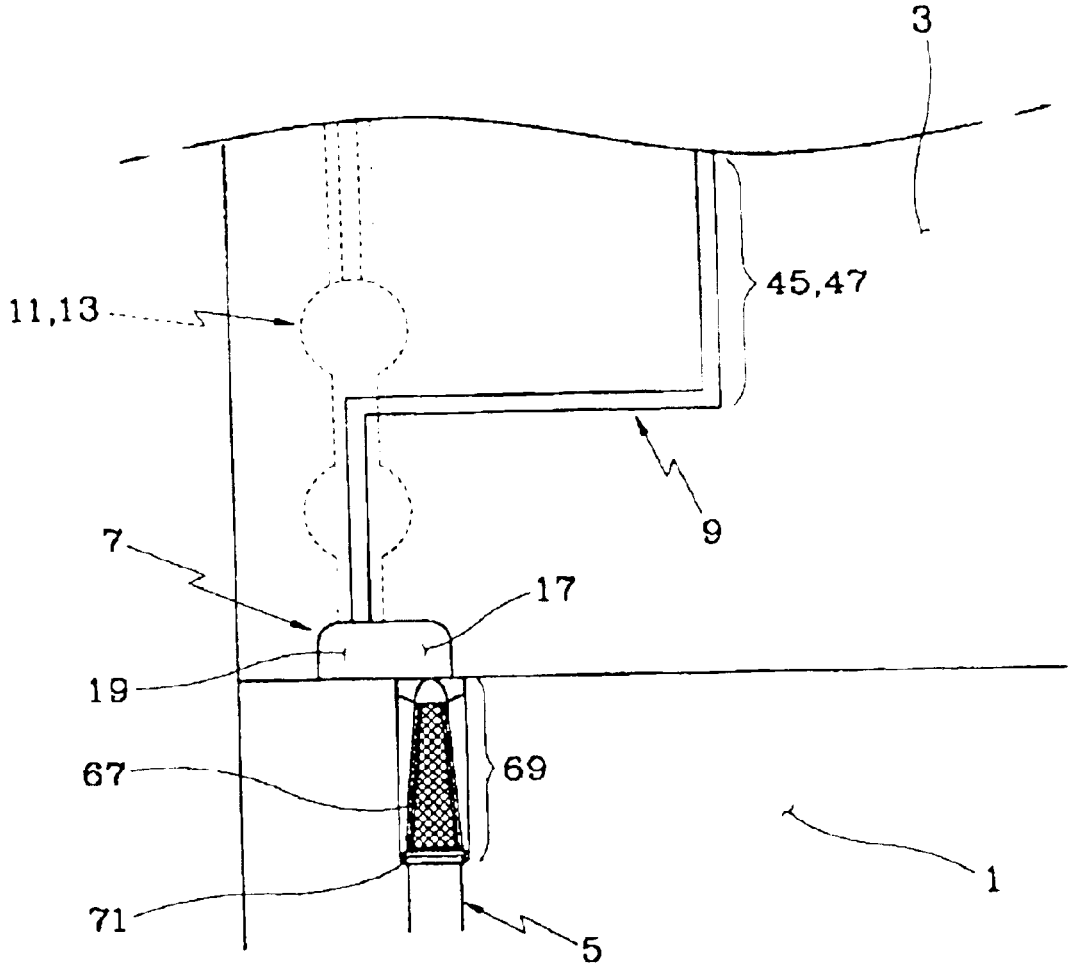
FIG. 3 is a schematic drawing observed from the right side of FIG. 1.

Referring back to FIGS. 1 and 3, the main oil gallery 5 of the cylinder block 1 is mounted with an oil filter 67 for filtering the oil furnished to the oil chamber 7, whereby the oil supplied to the cylinder head 3 is sustained clean. In the installation structure of the oil filter 67, the main oil gallery 5 of the cylinder block 1 is vertically mounted with an oil filter insertion part 69 from the upper surface of the cylinder block 1 to the lower side thereof. The oil filter insertion part 69 is formed with a diameter contraction part 71 for limiting an inserted depth of the lower side of the oil filter 67 so as to be placed at the same flat surface as the lower surface of the cylinder head 3 by inserting the upper end of the oil filter 67 through a periphery of the chamber influx part 73.

In other words, when the cylinder head 3 is assembled at the upper side of the cylinder block 1 after inserting the oil filter 67 into the oil filter insertion part 69 at the upper side of the cylinder block 1, the upper end of the oil filter 67 is pushed into by the periphery of a chamber influx part 73, and the lower end thereof is fixed by the diameter contraction part 71, enabling easy installation of the oil filter 67.

As apparent from the foregoing, there is an advantage in the embodiment of the present invention, in that an engine having a variable valve timing apparatus utilizing an oil pressure as an operational power source is adapted to smoothly supply a lubricating oil to a cylinder head and an operational oil for a variable valve timing apparatus in a clean state, allowing for easy installation and maintenance of components of the oil temperature sensor and oil control valve constituting the variable valve timing apparatus.

What is claimed is:

1. An oil supply structure for an engine cylinder head, the structure comprising:

an oil chamber formed in said cylinder head to receive oil from a main oil gallery of a cylinder block at a lower portion of the cylinder head abutted on an upper portion of the cylinder block, wherein the oil chamber, as observed from a bottom of the cylinder head, is a groove formed along a longitudinal direction of the cylinder head, and wherein the groove is centrally formed with a contraction part narrowed in width thereof;

a cam shaft journal oil passage branching from the oil chamber for lubricating a cam shaft journal part; and an oil supply passage branching from the oil chamber for operating a variable valve timing apparatus.

2. The structure as defined in claim 1, wherein the oil supply passage is an intake-side oil supplying passage branching from the oil chamber for activation of an intake-side variable valve timing apparatus.

3. The structure as defined in claim 1, wherein the oil supply passage comprises:

an intake-side oil supply passage branching from the oil chamber for activation of an intake-side variable valve timing apparatus; and an exhaust-side oil supply passage branching from the oil chamber for activation of an exhaust-side variable valve timing apparatus.

4. The structure as defined in claim 1, wherein:

the main oil gallery of the cylinder block is connected to a chamber influx part which is an inner side of the cylinder head relative to the contraction part of the groove; and the cam shaft journal oil passage and an oil supply passage are connected to a chamber efflux part, which is an external side of the cylinder head relative to the contraction part of the groove.

5. The structure as defined in claim 3, wherein the intake-side oil supply passage and the exhaust-side oil supply passage respectively comprise:

a temperature sensor section so formed as to pass through an oil temperature sensor; and a control valve section connected to the temperature sensor section for supplying the oil to an oil control valve.

6. The structure as defined in claim 5, wherein the temperature sensor section is slanted upwards from the oil chamber to a lateral surface of the cylinder head.

7. The structure as defined in claim 5, wherein the control valve section faces the inner side of the cylinder head and is tilted from the temperature sensor section toward the cam shaft journal of the upper side of the cylinder head.

8. The structure as defined in claim 1, wherein the cam shaft journal oil passage comprises:

an intake-side journal part inlet section and an exhaust-side journal part inlet section each communicatively branched out to one intake-side journal part for supporting the intake-side cam shaft and to one exhaust-side journal part for supporting the exhaust-side cam shaft, in a state of being branched toward the upper side from the oil chamber;

an intake cam shaft section connected to the intake-side journal part inlet section for supplying the oil to another intake-side journal part which abuts on the intake-side cam shaft, through the inner side of the intake-side cam shaft; and an exhaust cam shaft section connected to the exhaust-side journal part inlet section for supplying the oil to another exhaust side journal part which abuts on the exhaust-side cam shaft, through the inner side of the exhaust-side cam shaft.

9. The structure as defined in claim 8, wherein the intake-side journal part inlet section and the exhaust-side journal part inlet section communicate with the second journal part of the cylinder head.

10. The structure as defined in claim 8, wherein the intake cam shaft section and the exhaust cam shaft section respectively comprise:

bearing cap grooves longitudinally formed in the direction encompassing the intake cam shaft or exhaust cam shaft at a bearing cap so as to communicate with the intake-side journal part inlet section or the exhaust-side journal part inlet section, influx through holes radially formed at the intake and exhaust cam shafts so as to communicate with the bearing cap grooves, hollow parts each centrally and longitudinally formed at the intake and exhaust cam shafts so as to communicate with the influx through holes, and efflux through holes radially formed at the intake and exhaust cam shafts meeting another intake and exhaust-side journal parts for supporting the intake and exhaust cam shafts so as to communicate with the hollow part.

11. The structure as defined in claim 10, wherein the bearing cap groove is connected with the intake-side journal part inlet section or the exhaust-side journal part inlet section at the bottom side of a cap protrusive part formed at one side of the bearing cap, and is formed to enclose the intake cam shaft or exhaust cam shaft by detouring a periphery of a cap bolt hole of the bearing cap.

12. The structure as defined in claim 1, wherein the main oil gallery of the cylinder block further comprises an oil filter for filtering the oil furnished to the oil chamber.

13. The structure as defined in claim 12, wherein the oil chamber, as observed from a bottom of the cylinder head, is a groove formed along the longitudinal direction of the cylinder head, wherein the groove is centrally formed with a contraction part narrowed in width thereof, wherein the main oil gallery of the cylinder block communicates with a chamber influx part which is an inner side of the cylinder head relative to the contraction part of the groove, wherein the cam shaft journal oil passage and an oil supply passage communicate with a chamber efflux part, which is an external side of the cylinder head relative to the contraction part of the groove.

14. The structure as defined in claim 13, wherein:

the oil filter is mounted at an oil filter insertion part vertically formed from the upper side of the cylinder block to the main oil gallery of the cylinder block in the lower side direction; and the oil filter insertion part is formed with a diameter contraction part for limiting an inserted depth of the lower side of the oil filter so as to be placed at the same flat surface as the lower surface of the cylinder head by inserting the upper end of the oil filter through the periphery of the chamber influx part.

15. The structure as defined in claim 1, wherein said variable valve timing apparatus includes an actuator for continuous variable valve timing.

* * * * *